US006593709B2

(12) United States Patent
Lee et al.

(10) Patent No.: US 6,593,709 B2
(45) Date of Patent: Jul. 15, 2003

(54) DUAL MODE ELECTRONIC DIMMER

(75) Inventors: Sang-Woo Lee, Pucheon (KR); Dong-Young Huh, Pucheon (KR)

(73) Assignee: Fairchild Korea Semiconductor Ltd., Kyungki-do (KR)

( * ) Notice: Subject to any disclaimer, the term of this patent is extended or adjusted under 35 U.S.C. 154(b) by 0 days.

(21) Appl. No.: 09/953,513

(22) Filed: Sep. 14, 2001

(65) Prior Publication Data

US 2002/0060537 A1 May 23, 2002

(30) Foreign Application Priority Data

Sep. 15, 2000 (KR) ..... 2000-54147

(51) Int. Cl.[7] ..... H05B 37/00
(52) U.S. Cl. ..... 315/302; 315/291; 315/DIG. 4
(58) Field of Search ..... 315/DIG. 4, 291, 315/302

(56) References Cited

U.S. PATENT DOCUMENTS 6,339,298 B1 * 1/2002 Chen ..... 315/224

* cited by examiner

*Primary Examiner*—David Vu
(74) *Attorney, Agent, or Firm*—Marshall, Gerstein & Borun

(57) ABSTRACT

An electronic lamp dimmer includes a burst dimmer circuit and an analog dimmer circuit formed adjacent to each other on an integrated circuit substrate. The burst dimmer circuit controls the illumination intensity of a lamp over a first operating range and the analog dimmer circuit controls the illumination intensity of the lamp over a second operating range that overlaps the first operating range. The electronic dimmer includes a plurality of electrical contacts, each of which is electrically coupled to one of the burst dimmer and analog dimmer circuits and one of which simultaneously provides a dimming control voltage to both of the burst dimmer and analog dimmer circuits.

9 Claims, 2 Drawing Sheets

DUAL MODE ELECTRONIC DIMMER

BACKGROUND OF THE INVENTION

1. Field of the Invention

The invention relates generally to an electronic dimmer for dimming the brightness of a lamp and, more particularly, the invention relates to an electronic dimmer that uses analog and burst dimming to control the brightness of a lamp.

2. Description of the Related Technology

Typically, a liquid crystal display (LCD) backlight inverter uses analog and burst dimming to control the brightness of a cold cathode fluorescent lamp (CCFL), which is generally used to provide backlight illumination. Generally speaking, analog dimming techniques use an error amplifier that compares a reference or dimming control voltage to a voltage representative of lamp current to control the brightness of the lamp. On the other hand, burst dimming techniques may use a duty-cycle modulated output signal having a frequency in the range of about 200 Hertz (Hz) to about 100 kilohertz (kHz) to control the brightness of a lamp.

In some cases, burst dimming may be used in combination with analog dimming because analog dimming does not effectively control the brightness of a lamp from zero to one hundred percent. Unfortunately, conventional integrated circuits that provide a combination of analog and burst dimming control capability require two pins to perform these functions (i.e., one pin for each of the analog and burst dimming functions).

SUMMARY OF THE INVENTION

In accordance with one aspect of the invention, an electronic dimmer includes a main switch controller for receiving a sawtooth waveform having a predetermined frequency and an amplitude and for receiving a voltage signal having a maximum value greater than the amplitude. The voltage signal may be received via a dimming terminal and the main switch controller may be adapted to generate a burst dimming signal for use in controlling a switch by comparing the voltage signal with the sawtooth waveform. The electronic dimmer may also include a current supply starter for generating a current supply starting signal when the voltage signal is greater than the maximum value and a current source for supplying a current for varying a reference voltage according to the current supply starting signal. The electronic dimmer may further include a reference voltage generator for generating a reference voltage when substantially no current is provided via the current source. The reference voltage generator may be adapted to vary the reference voltage based on the current supplied by the current source. Additionally, the electronic dimmer may include a feedback unit for comparing the reference voltage to a voltage generated by a load current and for varying the brightness of a lamp based on the reference voltage.

In accordance with another aspect of the invention, an electronic dimmer includes an integrated circuit substrate and a burst dimmer circuit formed on the integrated circuit substrate. The burst dimmer circuit may be adapted to control the illumination intensity of a lamp over a first operating range. The electronic dimmer may also include an analog dimmer circuit formed on the integrated circuit substrate adjacent to the burst dimmer circuit, and the analog dimmer circuit may be adapted to control the illumination intensity of the lamp over a second operating range that overlaps the first operating range. Additionally, the electronic dimmer may include a plurality of electrical contacts, each of which is electrically coupled to one of the burst dimmer and analog dimmer circuits and one of which provides a dimming control voltage to both of the burst dimmer and analog dimmer circuits.

The invention itself, together with further objectives and attendant advantages, will best be understood by reference to the following detailed description, taken in conjunction with the accompanying drawings and the appended claims.

DETAILED DESCRIPTION OF THE PREFERRED EMBODIMENTS

Figure 1:
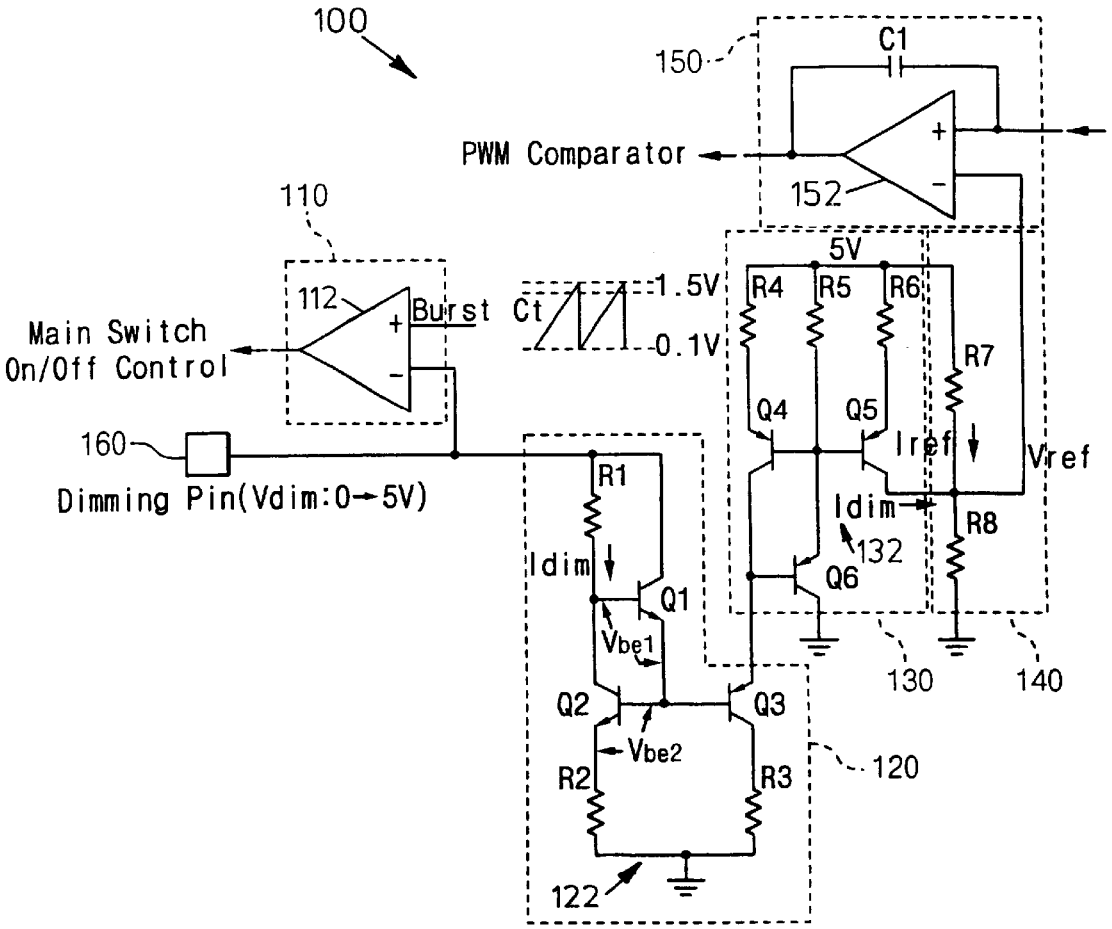
FIG. 1 is an exemplary schematic diagram of a dual mode electronic dimmer that uses a single pin to control analog and burst dimming functions.

FIG. 1 is an exemplary schematic diagram of a dual mode electronic dimmer 100 that uses a single pin to control analog and burst dimming functions. As shown in FIG. 1, the electronic dimmer 100 includes a main switch controller 110, a current supply starter 120, a current source 130, a reference voltage generator 140 and a feedback unit 150. In the embodiment shown in FIG. 1, the main switch controller 110 and the current supply starter 120 are connected to a single dimming pin 160 that receives a dimming control voltage signal (Vdim) of a predetermined range such as, for example, zero to five volts direct current (DC).

The main switch controller 110 includes a comparator 112 having a non-inverting terminal for receiving a sawtooth waveform and an inverting terminal for receiving the dimming control voltage signal (Vdim) via the dimming pin 160. The comparator 112 compares the sawtooth waveform and the dimming control voltage signal Vdim and may generate a square wave output signal for controlling on/off operations of a main switch (not shown) that may be connected to a lamp, thereby enabling burst dimming of the lamp. By way of example, the amplitude of the sawtooth waveform may range from about 0.1 volt (V) to about 1.5 V and may have a frequency of about 200 Hz. Additionally, the dimming control voltage signal Vdim at the dimming pin 160 may range from about 0.0 V to 5 V. Of course, other waveform amplitudes and frequencies as well as different control voltage amplitudes may be used instead without departing from the scope and the spirit of the invention.

In operation, the main switch controller 110 outputs a logical high during the intervals in which the amplitude of the sawtooth waveform is greater than the dimming control voltage Vdim. Thus, the period during which the output of the main switch controller 110 remains in a logical high condition will decrease as the dimming control voltage Vdim approaches 1.5 V. In other words, the duty cycle of the output of the main switch controller 110 decreases as Vdim approaches 1.5 V. Conversely, the duty cycle of the output of the main switch controller 110 increases as Vdim approaches zero volts. In this manner, the output of the main switch controller 110 may be pulse-width modulated to thereby control the average power provided to a lamp and, thus, the resulting illumination provided by the lamp. Preferably, but not necessarily, the main switch controller 110 may be configured to drive a lamp (not shown) so that as the dimming voltage Vdim increases (i.e., the duty cycle of the main switch controller 110 decreases), the lamp becomes brighter and so that as the dimming voltage Vdim decreases (i.e., the duty cycle of the main switch controller 110 increases), the lamp becomes dimmer.

As shown in FIG. 1, the current supply starter 120 includes transistors Q1, Q2 and Q3 and resistors R1, R2 and R3, all of which may be connected as shown. One end of the resistor R1 is connected to the dimming pin 160 so that when the voltage Vdim becomes greater than a predetermined voltage, the current supply starter 120 is activated and generates a current supply starting signal. As one skilled in the art may recognize, the transistors Q2 and Q3 form a current mirror 122 such that the current flowing through the transistor Q3 is determined according to the ratio of the resistances of the resistors R2 and R3.

In operation, the transistors Q1 and Q2 become active (i.e., conduct current) when the sum of their respective base-emitter voltages Vbe1 and Vbe2 is greater than about 1.4V. Thus, when the dimming control voltage Vdim supplied to the dimming pin 160 is less than 1.4 V, the transistors Q1 and Q2 are substantially inactive and do not conduct current between their respective collector and emitter terminals. As a result, the lamp being controlled receives burst dimming inputs via the main switch controller 110. On the other hand, when the dimming control voltage Vdim supplied to the dimming pin 160 is greater than 1.4 V, the transistors Q1 and Q2 are active or turned on, and the dimming control current flowing through the transistor Q2 is determined according to Equation 1 below.

$$I_{dim} = \frac{V_{dim} - 2Vbe}{R1 + R2} \qquad \text{Equation 1}$$

Because the transistor Q3 is part of the current mirror 122, the current flowing through the transistor Q3 is determined by the ratio of the resistances of the resistors R2 and R3. Preferably, but not necessarily, the resistances of the resistors R2 and R3 are equal so that the current Idim, as calculated using Equation 1, flows through transistors Q2 and Q3 and so that the current Idim flowing through the transistor Q3 becomes the current supply starting signal.

Because Vbe is typically about 0.7 V and because the main switch controller 110 provides burst dimming inputs to the lamp for dimming control voltages up to about 1.5 V, the operation of the burst dimming function and the analog dimming function, which is controlled by Idim, will overlap between about 1.4 V and 1.5 V. In this manner, the electronic dimmer 100 provides a more seamless transition between the full burst dimming mode of operation and the full analog dimming mode of operation, thereby reducing or eliminating perceptible lamp flicker.

The current source 130 includes a current mirror 132 that supplies a current for varying a reference voltage Vref based on the current supply starting signal output provided by the current supply starter 120. The current source 130 also includes transistors Q4, Q5, Q6 and Q7 and resistors R4, R5 and R6, all of which may be connected as shown. As sown in FIG. 2, the transistors Q4 and Q5 are connected in a current mirror configuration.

In operation, the current source 130 is not active when the dimming control voltage Vdim is less than about 1.4 V. In that case, the current supply starter 120 does not provide a starting current to the current source 130 and, as a result, the current source 130 does output a current to increase the voltage Vref above the voltage level set by the resistive divider formed by resistors R7 and R8 of the reference voltage generator 140. However, when the dimming control voltage Vdim is greater than about 1.4 V, the current supply starter 120 generates a current Idim according to Equation 1 above and, thus, a current Idim is added to the current Iref, thereby increasing the reference voltage Vref in proportion to the magnitude of Idim.

As shown in FIG. 1, the reference voltage generator 140 is connected between a 5 V potential and a ground potential. The reference voltage generator 140 generates a reference voltage between about 5 V and zero volts based on the magnitude of the current Idim being provided by the current source 130 to the resistive divider formed by the resistors R7 and R8. More specifically, when the dimming control voltage Vdim is between about zero volts and 1.4V, the current supply starter 120 does not supply any substantial current to the current source 130 and, as a result, the current mirror 132 does not supply current (i.e., Idim) to the resistors R7 and R8. Thus, in that case, the output voltage Vref is based only on the ratio of the resistances of the resistors R7 and R8 in accordance with Equation 2 below.

$$V_{ref} = 5V * \frac{R8}{R7 + R8} \qquad \text{Equation 2}$$

On the other hand, when the dimming control voltage Vdim is greater than about 1.4 V, the current supply starter 120 begins to operate and the current Idim begins to flow into the resistor R8, thereby increasing the reference voltage Vref, and enabling analog dimming of a lamp.

As shown in FIG. 1, the feedback unit 150 includes a comparator 152 having an inverting terminal that is connected to one end of the resistor R8 of the reference voltage generator 140 and a non-inverting terminal that is connected to a voltage representative of a load current flowing through a lamp. Thus, the comparator 152 may compare the reference voltage Vref to the voltage representative of the load current flowing through the lamp to generate an error signal. The error signal generated by the feedback unit 150 may then be used to control the brightness of the lamp by appropriately varying the voltage or current being delivered to the lamp. When the signal voltage supplied to the dimming pin 160 is between about zero volts and 1.4V, the feedback unit 150 receives the reference voltage as represented by Equation 2, and when the signal voltage Vdim is between 1.4V to 5V, the feedback unit 150 performs analog dimming by varying the reference voltage Vref.

Figure 2:
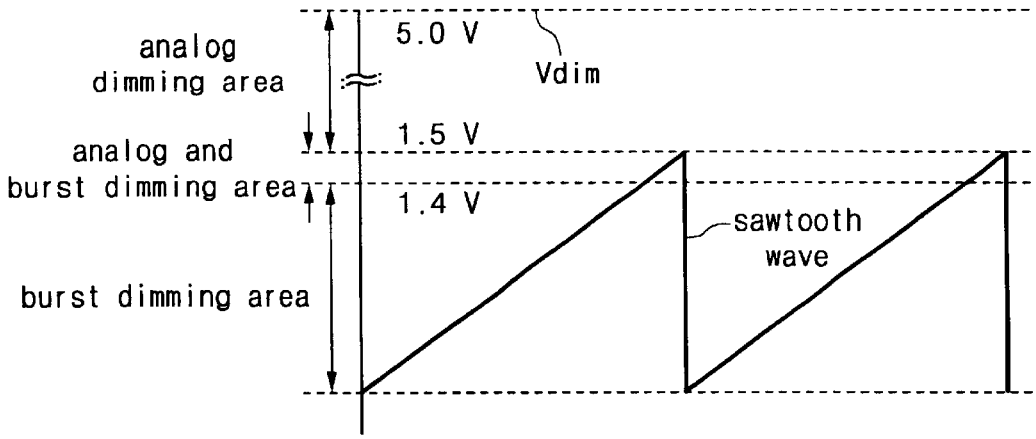
FIG. 2 depicts an exemplary waveform associated with the electronic dimmer shown in FIG. 1.

FIG. 2 depicts an exemplary waveform associated with the electronic dimmer 100 shown in FIG. 1. As shown in FIG. 2, a sawtooth waveform having an amplitude between 0.1V to 1.5V and a frequency of about 200 Hz may be supplied to the non-inverting terminal of the main switch controller 110. Thus, when the dimming control signal voltage Vdim is between about 0.1 V and 1.5V, the output of the main switch controller 110 is in a logical high condition, and the main switch (not shown) is turned off so that current is not provided to the lamp, when the amplitude of the sawtooth waveform is greater than the dimming control voltage Vdim. As a result, as the dimming control signal voltage Vdim increases, the interval during which the main switch controller 110 is in a logical high condition (i.e., current is being supplied to the lamp) increases and the lamp becomes brighter. While the dimming control signal voltage Vdim is less than about 1.5 V, the current Idim is substantially near zero amperes and can be ignored. Furthermore, with Idim substantially near zero amperes, the reference voltage Vref is substantially fixed as determined by the resistors R7 and R8 in accordance with Equation 2 above.

Because analog dimming is initiated when the signal voltage Vdim is greater than 1.4V, burst dimming and analog dimming are concurrently executed when the dimming control voltage Vdim is between 1.4V to 1.5V. As described above, in the interval during which burst dimming and analog dimming are concurrently executed, the brightness of the lamp is linearly varied so that flickering of the lamp is removed during the transition between burst and analog dimming modes. When the dimming control signal voltage Vdim is greater than about 1.5V, the brightness is varied only by the analog dimming without burst dimming.

Further, the variations of Vbe in response to temperature variations may be offset by the resistors R1 and R2 so that the current Idim is determined primarily by the resistor R1, the transistors Q1 and Q2 and the resistor R2, which function as a temperature stabilized current source. Likewise, the current Iref that flows to the resistor R8 and which has a value identical to the current Idim does not vary significantly in response to temperature variations.

Therefore, when analog dimming is executed, the reference voltage Vref is varied within a predetermined range because of the variations of the current Idim, and the reference voltage of the feedback unit 150 is varied to control the brightness. In this instance, the variations of the reference voltage of the feedback unit 150 can be obtained by setting an operation area according to an application system and appropriately adjusting the resistors R1, R2, R7 and R8.

A range of characteristics and modifications can be made to the preferred embodiment described above. The foregoing detailed description should regarded as illustrative rather than limiting and the following claims, including all equivalents, are intended to define the scope of the invention.

What is claimed is:

1. An electronic dimmer comprising:

a main switch controller for receiving a sawtooth waveform having a predetermined frequency and an amplitude and for receiving a voltage signal having a maximum value greater than the amplitude, wherein the voltage signal is received via a dimming terminal and wherein the main switch controller is adapted to generate a burst dimming signal for use in controlling a switch by comparing the voltage signal with the sawtooth waveform;

a current supply starter for generating a current supply starting signal when the voltage signal is greater than the maximum value;

a current source for supplying a current for varying a reference voltage according to the current supply starting signal;

a reference voltage generator for generating a reference voltage when substantially no current is provided via the current source, wherein the reference voltage generator is adapted to vary the reference voltage based on the current supplied by the current source; and a feedback unit for comparing the reference voltage to a voltage generated by a load current and for varying the brightness of a lamp based on the reference voltage.

2. The electronic dimmer of claim 1, wherein the current supply starter comprises a current mirror that includes two transistors and, when the voltage signal is greater than the maximum value of the amplitude, the current supply starter generates the current supply starting signal and each of the two transistors conducts substantially identical currents.

3. The electronic dimmer of claim 1, wherein the current source comprises a current mirror that includes two transistors, and when the current supply starting signal flows to one of the two transistors, the current source supplies the current for varying the reference voltage to the other one of the two transistors.

4. The electronic dimmer of claim 1, wherein the main switch controller comprises a comparator having a first terminal for receiving the sawtooth waveform and a second terminal for receiving the voltage signal.

5. The electronic dimmer of claim 1, wherein the current supply starter comprises:

a first resistor having a first terminal connected to a dimming pin and the main switch controller;

a first transistor having a collector connected to the first resistor and the dimming terminal, and a base connected to a second terminal of the first resistor;

a second transistor having a collector connected to the second terminal of the first resistor and the base of the first transistor, and a base connected to an emitter of the first transistor;

a third transistor having a base connected to the emitter of the first transistor and the base of the second transistor;

a second resistor having a first terminal connected to the emitter of the second transistor, and a second terminal connected to a ground potential; and a third resistor having a first terminal connected to an emitter of the third transistor, and a second terminal connected to the ground potential.

6. The electronic dimmer of claim 1, wherein the current source comprises:

a first resistor having a first terminal connected to a voltage source;

a first transistor having an emitter connected to a second terminal of the first resistor;

a second resistor having a first terminal connected to the voltage source, and a second terminal connected to a base of the first transistor;

a third resistor having a first terminal connected to the voltage source;

a second transistor having an emitter connected to a second terminal of the third resistor, and a base connected to the base of the first transistor and the second terminal of the second resistor; and a third transistor having a base connected to the current supply starter and a collector of the first transistor, an emitter connected to the base of the first transistor and the second terminal of the second resistor, and a collector connected to a ground potential.

7. The electronic dimmer of claim 1, wherein the reference voltage generator comprises:

a first resistor having a first terminal connected to a voltage source and a second terminal connected to the current source; and a second resistor having a first terminal connected to the second terminal of the first resistor and a second terminal connected to a ground potential.

8. The electronic dimmer of claim 2, wherein a sum of the base-emitter turn on voltages of the two transistors is less than a maximum amplitude of the sawtooth waveform.

9. The electronic dimmer of claim 5, wherein temperature induced voltage variations between the bases and the emitters of the respective first and second transistors are offset by the first and second resistors.

* * * * *